US008463161B2

(12) United States Patent
Mori

(10) Patent No.: US 8,463,161 B2
(45) Date of Patent: Jun. 11, 2013

(54) IMAGE FORMING APPARATUS HAVING TRANSFER BELT SPACING MECHANISM

(75) Inventor: Hideki Mori, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 267 days.

(21) Appl. No.: 13/036,284

(22) Filed: Feb. 28, 2011

(65) Prior Publication Data

US 2011/0211871 A1 Sep. 1, 2011

(30) Foreign Application Priority Data

Mar. 1, 2010 (JP) ..... 2010-044327

(51) Int. Cl.
*G03G 15/08* (2006.01)

(52) U.S. Cl.
USPC ..... 399/121

(58) Field of Classification Search
USPC ..... 399/121, 297, 302, 303, 308, 313
See application file for complete search history.

(56) References Cited

U.S. PATENT DOCUMENTS 6,571,073 B1 * 5/2003 Suzuki et al. ..... 399/116
7,133,631 B2 * 11/2006 Ito et al. ..... 399/302
7,257,351 B2 * 8/2007 Tachiki et al. ..... 399/121
7,454,158 B2 * 11/2008 Nakano et al. ..... 399/121
7,620,353 B2 * 11/2009 Kwak ..... 399/302
8,064,797 B2 * 11/2011 Sugiyama ..... 399/121
8,238,790 B2 * 8/2012 Furuya et al. ..... 399/121

FOREIGN PATENT DOCUMENTS

JP 10282803 A * 10/1998
JP 10293514 A * 11/1998
JP 2003-43828 A 2/2003
JP 2003-98840 A 4/2003

* cited by examiner

*Primary Examiner* — Robert Beatty
(74) *Attorney, Agent, or Firm* — Fitzpatrick, Cella, Harper & Scinto

(57) ABSTRACT

An image forming apparatus includes an image bearing member; a belt unit which is rotatable in contact with the image bearing member and which is capable of being drawn out of a main assembly of the image forming apparatus; a cam member for switching a position of the belt member relative to the image bearing member; a motor for rotating the cam member; a controller for controlling the motor to contact and space the belt member relative to the image bearing member; a lever movable between a first position in which the belt member is fixed to the main assembly of the image forming apparatus and a second position in which the belt member is capable of being drawn out of the main assembly of the image forming apparatus; and a spacing mechanism for spacing the belt member from the image bearing member by converting movement of the lever from the first position to the second position to a rotation of the cam member, when the belt member is contacted to the image bearing member.

9 Claims, 8 Drawing Sheets

IMAGE FORMING APPARATUS HAVING TRANSFER BELT SPACING MECHANISM

FIELD OF THE INVENTION AND RELATED ART

The present invention relates to an image forming apparatus in which a belt member is contacted and spaced relative to an image bearing member by driving a cam member by a motor, more particularly to an image forming apparatus comprising a mechanism for spacing the belt member by a manual operation when the electric power supply is shut off in the state that the belt member is in contact with the image bearing member.

An image forming apparatus in which a belt member (an intermediary transfer belt, a recording material feeding belt, a transfer belt) is contacted to the image bearing member during an image forming operation is widely used. In the image forming apparatus using the belt member, a belt unit comprising the belt member is drawable out of a main assembly of the image forming apparatus to facilitate inspection, exchange, jam clearance and so on of the belt member (FIG. 2).

When the image forming apparatus is kept unoperated with the belt member in contact with the image bearing member in such an apparatus, there is a liability that contact portions of the belt member and/or a transfer roller is deformed, or electrical properties of the contact portion changes due to moisture absorption or the like. Japanese Laid-open Patent Application 2003-98840 and Japanese Laid-open Patent Application 2003-43828 propose that a mechanism for spacing automatically the belt member from the image bearing member is provided, and after completion of the image formation, the belt member is spaced from the image bearing member, and then the power supply is shut off.

Japanese Laid-open Patent Application 2003-98840 discloses an image forming apparatus in which a transfer unit integrally comprising a transfer belt and a plurality of supporting rotatable member is automatically contacted and spaced relative to a photosensitive drum. Here, a solenoid included in the transfer unit is operated, by which the transfer unit is rotated about a driving roller to space the transfer belt from the photosensitive drum.

If, however, the used solenoid is not a self-holding type, the electric power supply to the solenoid has to be kept during the image forming operation, which requires quite a large electric power consumption. When a cam member is used, the electric power consumption can be saved because it has self-holding function.

In Japanese Laid-open Patent Application 2003-43828 discloses a structure with which the transfer belt is contacted and spaced relative to the photosensitive drum, and a structure with which the entirety of the transfer unit having the transfer belt is moved to further space the transfer belt.

With such structures, the contact between the transfer belt and the photosensitive drum during jam clearance can be avoided, by moving the entirety of the transfer unit in the direction away from the photosensitive drum by a manual operation.

However, since the entirety of the transfer belt unit is movable away from the photosensitive drum, in addition to the structure of moving the transfer belt per se, a retraction space for the entirety of the transfer belt unit is required.

SUMMARY OF THE INVENTION

Accordingly, it is a principal object of the present invention to provide an image forming apparatus wherein when the apparatus stops in a state that a transfer belt is in contact with an image bearing member, the transfer belt can be spaced from the image bearing member, with a compact structure.

According to another aspect of the present invention, there is provided an image forming apparatus comprising an image bearing member; a belt unit which is rotatable in contact with said image bearing member and which is capable of being drawn out of a main assembly of the image forming apparatus; a cam for switching a position of said belt member relative to said image bearing member; a motor for rotating said cam; control means for controlling said motor to contact and space said belt member relative to said image bearing member; a lever movable between a first position in which said belt unit is fixed to said main assembly of the image forming apparatus and a second position in which said belt unit is capable of drawn out of said main assembly of the image forming apparatus; and a spacing mechanism for spacing said belt from said image bearing member by converting movement of said lever from the first position to the second position to a rotation of said cam, when said belt member is contacted to said image bearing member.

DESCRIPTION OF THE PREFERRED EMBODIMENT

Embodiments of the present invention will be described in detail referring to the accompanying drawings. The present invention can be implemented even if a part or all of the structures of the embodiment are replaced with alternative structures as long as a cam member is rotated by a driving motor to contact and space a belt member relative to an image bearing member.

Therefore, the present invention can be implemented in an image forming apparatus irrespective of whether it is a charging type, an electrostatic image formation system, a developing system or the like, or irrespective of whether it is an intermediary transfer type, a recording material feeding type, a transfer belt type, as long as it uses a belt.

In the following, only the major parts as to the toner image formation will be described, but the present invention can be applicable to a printer, various printing machines, facsimile machine, complex machine and so on.

<Image Forming Apparatus>

Figure 1:
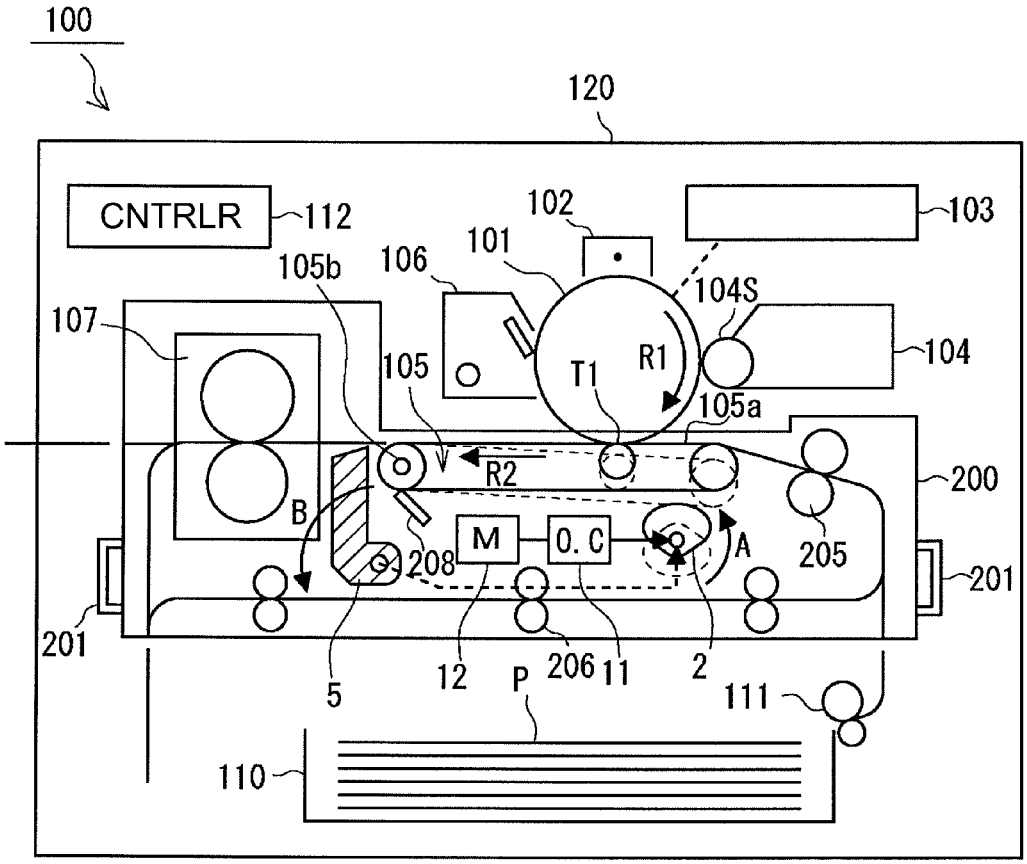
FIG. 1 is an illustration of a structure of an image forming apparatus.
Figure 2:
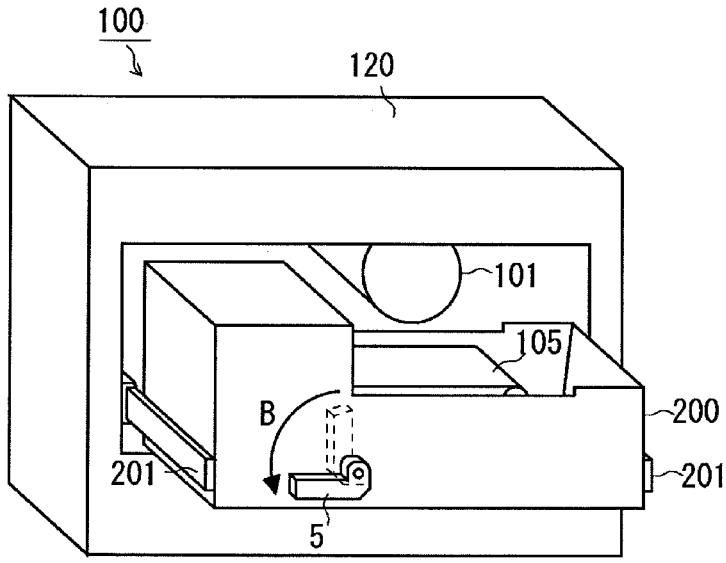
FIG. 2 is an illustration of a drawing structure of a feeding unit.
Figure 3:
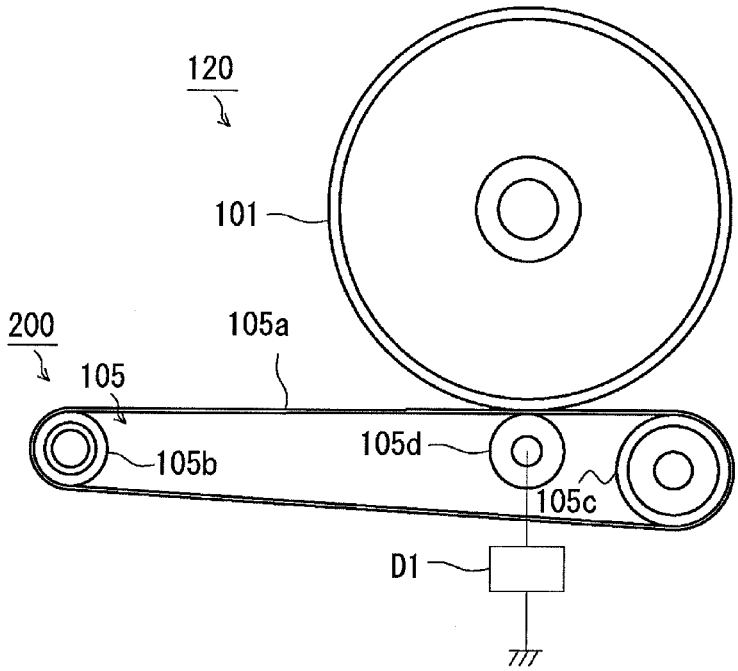
FIG. 3 is an illustration of a structure of a transfer unit.

FIG. 1 is an illustration of a structure of an image forming apparatus. FIG. 2 is an illustration of a drawing structure of a feeding unit. FIG. 3 is an illustration of a structure of a transfer unit.

As shown in FIG. 1, an image forming apparatus 100 is a monochromatic high speed printer wherein a toner image formed on a photosensitive drum 101 is transferred onto a recording material P carried on a transfer belt 105*a*.

Around the photosensitive drum 101 (image bearing member), there are provided a corona charger 102, an exposure device 103, a developing device 104, a transfer unit 105 and a drum cleaning device 106. The photosensitive drum 101 comprises an aluminum cylinder and a photosensitive layer on an outer surface thereof and rotates in a direction of an arrow R1 at a process speed of 700 mm/sec.

The corona charger 102 produces charged particles which are applied on the surface of the photosensitive drum 101 to electrically charge it to a uniform negative potential. The exposure device 103 produces a laser beam ON-OFF modulated with scanning line image data corresponding to an input image, and deflects the beam by a rotational mirror to scan the charged surface of the photosensitive drum 101, thus writing an electrostatic image thereon. The developing device 104 develops the electrostatic image formed on the photosensitive drum 101 into a toner image.

The transfer unit 105 forms a transfer portion T1 between the photosensitive drum 101 and the transfer belt 105*a*. The recording material P stored in a recording material cassette 110 is fed one by one with the aid of a separation roller 1111 to registration rollers 205. The registration rollers 205 which are not rotating catch the recording material P and then feed the recording material P to the transfer portion T1 in timed relation with the toner image on the photosensitive drum 101.

The transfer unit 105 supplied with a positive DC voltage by which the toner image carried on the photosensitive drum 101 is transferred onto the recording material P which is carried on the transfer belt 105*a* and is passing through the transfer portion T1.

The recording material P having received the toner image is separated from the transfer belt 105*a* by the curvature and is fed to a fixing device 107, where it is subjected to heat pressing operation by the fixing device 107, so that the toner image is fixed by the heat on the surface of the recording material P, which is then discharged to the outside of the main assembly 120 of the image forming apparatus. The drum cleaning device 106 includes a cleaning blade which is contacted to the photosensitive drum 101 to remove from the photosensitive drum 101 untransferred toner not transferred onto the recording material P.

A controller 112, a one-way clutch 11 and a driving motor 12 which constitute an example of control means control rotation of a pressing cam 2 to contact and space the transfer unit 105 relative to the photosensitive drum 101.

The controller 112 controls the driving motor 12 to rotate the pressing cam 2 unidirectionally to switch between the contact state and the spaced state alternately.

<Drawing Structure>

As shown in FIG. 2, a feeding unit 200 is supported by left and right slide guides 201 so that it can be drawn out from the main assembly 120 of the image forming apparatus toward the front side (longitudinal direction of the photosensitive drum 101). When the feeding unit 200 is drawn out to the front side, the transfer unit 105 can be removed upwardly.

The feeding unit 200 which is an example of the belt unit includes the rotatable transfer belt 105*a* which is contacted to the photosensitive drum 101, and can be drawn out from the main assembly 120 of the image forming apparatus comprising the photosensitive drum 101.

The feeding unit 200 can be drawn out in the longitudinal direction of the photosensitive drum 101. A handle 5 which is an example of the operating member (lever) is manually operable between a first position and a second position. The handle 5 is disposed in the front side of the feeding unit 200 and is manually operable between the first position and the second position. In the first position of the handle 5, the belt unit is fixed to the main assembly of the image forming apparatus. In the second position of the handle 5, the belt unit can be drawn out of the main assembly of the image forming apparatus.

When the handle 5 disposed in a front side of the feeding unit 200 is rotated from the first position counterclockwisely by 90 degrees, a locking mechanism releases the feeding unit 200 from the main assembly 120 of the image forming apparatus to permit the feeding unit 200 to be drawn out toward the front side. By rotating the handle 5 from the first position counterclockwisely to the second position by 90 degrees, the transfer unit 105 lowers to space from the photosensitive drum 101. Therefore, at the time of drawing the feeding unit 200 out, the transfer unit 105 is already spaced from the photosensitive drum 101, so that sliding contact between the transfer unit 105 and the photosensitive drum 101 can be avoided.

As shown in FIG. 3, the transfer belt 105*a* which is an example of the belt member is assembled into the transfer unit 105 integrally with a driving roller 105*b* and stretching rollers 105*c* which are examples of supporting rotatable members. The transfer unit 105 which is an example of the belt unit is rotatable about the driving roller 105*b* which is an example of the supporting rotatable member, and the pressing cam 2 moves an end of the transfer unit 105 up and down.

In the transfer unit 105, the transfer belt 105*a* is stretched by the driving roller 105*b* and the stretching roller 105*c*, and a transfer roller 105*d* is provided inside the transfer belt 105*a*. The transfer roller 105*d* is press-contacted to an inner side surface of the transfer belt 105*a* supported by the photosensitive drum 101 at a predetermined urging force to form a press-contact nip (transfer portion T1) between the transfer belt 105*a* and the photosensitive drum 10. The transfer belt 105*a* is driven by the driving roller 105*b* to travel at a peripheral speed substantially equal to the peripheral speed of the photosensitive drum 101.

When the transfer belt 105*a* is kept unoperated for a long term while it is press-contacted to the photosensitive drum 101, substances in the rubber material of the transfer belt 105*a* oozes out to the surface thereof and is deposited to the photosensitive drum 101, with the possible result of defective image. For this reason, it is desired to provide a mechanism for releasing the transfer belt 105*a* from the press-contact when the image forming apparatus 100 does not perform the image forming operation.

As described hereinbefore, in this embodiment, the pressing is effected during image formation and is not effected during non-image-formation period. However, when the electric power supply is shut off during the press-contact state, it is not possible to operate the driving motor, and therefore, another spacing mechanism is desired.

In this embodiment, there is provided a transmitting mechanism (space mechanism) with which the lever is operated manually to rotate the cam member to space the transfer unit 105 from the photosensitive drum 101. The structure is such that when the lever takes at least the first position, the transmitting mechanism does not interrupt the rotation of the cam member by the driving motor, by which the automatic rotation and the manual rotation are accomplished to the common cam member. By this, the contact state and the space state of the transfer unit 105 by the driving motor can be controlled as desired.

<Embodiment 1>

Figure 4:
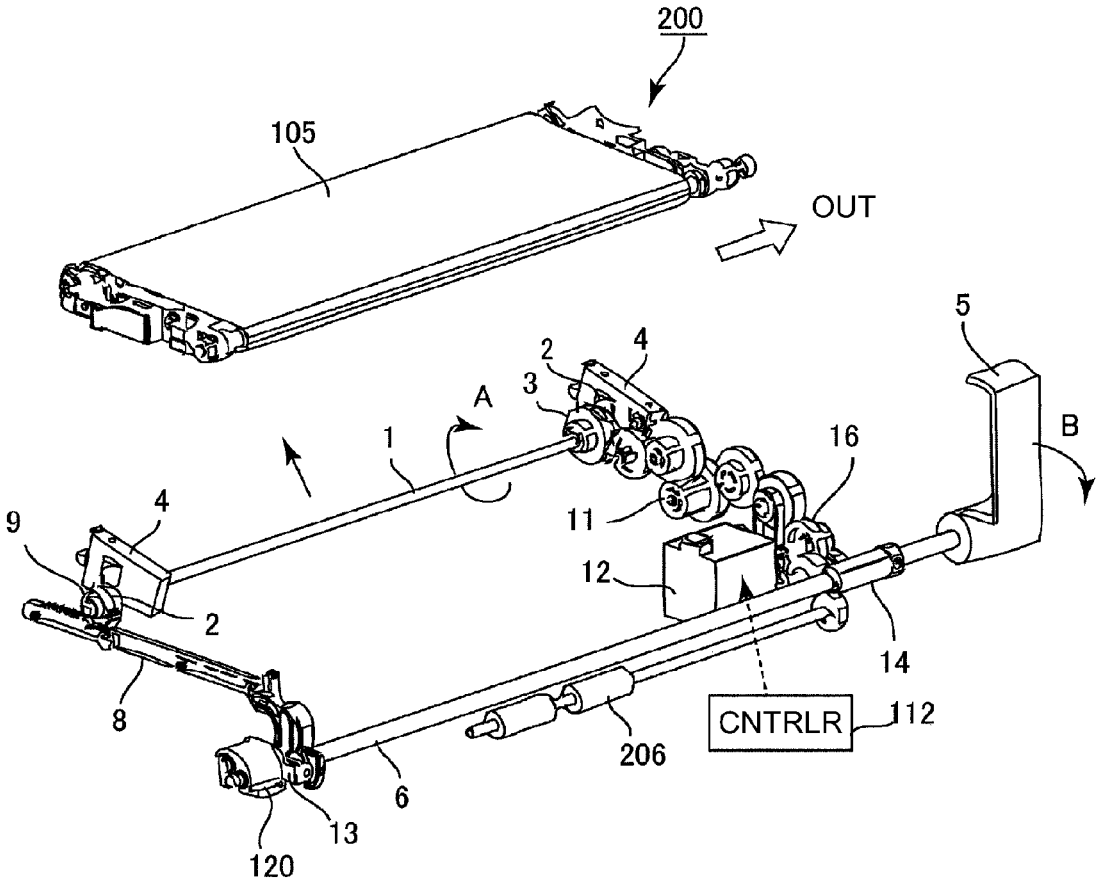
FIG. 4 is a perspective view of a transfer unit elevating mechanism in an Embodiment 1 of the present invention.

FIG. 4 is a perspective view of a transfer unit elevating mechanism in an Embodiment 1 of the present invention.

Figure 5:
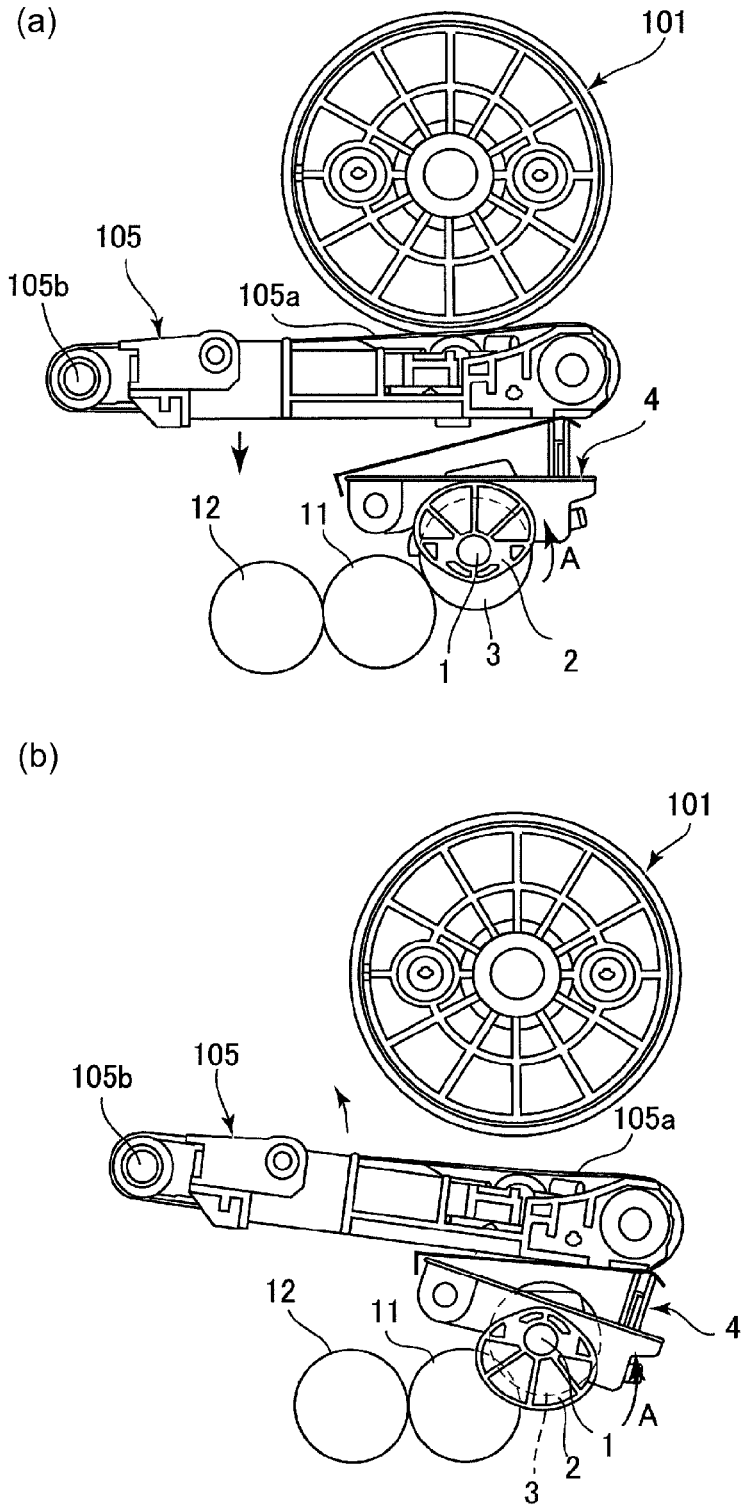
FIG. 5 is an illustration of an operation of a cam member.
Figure 6:
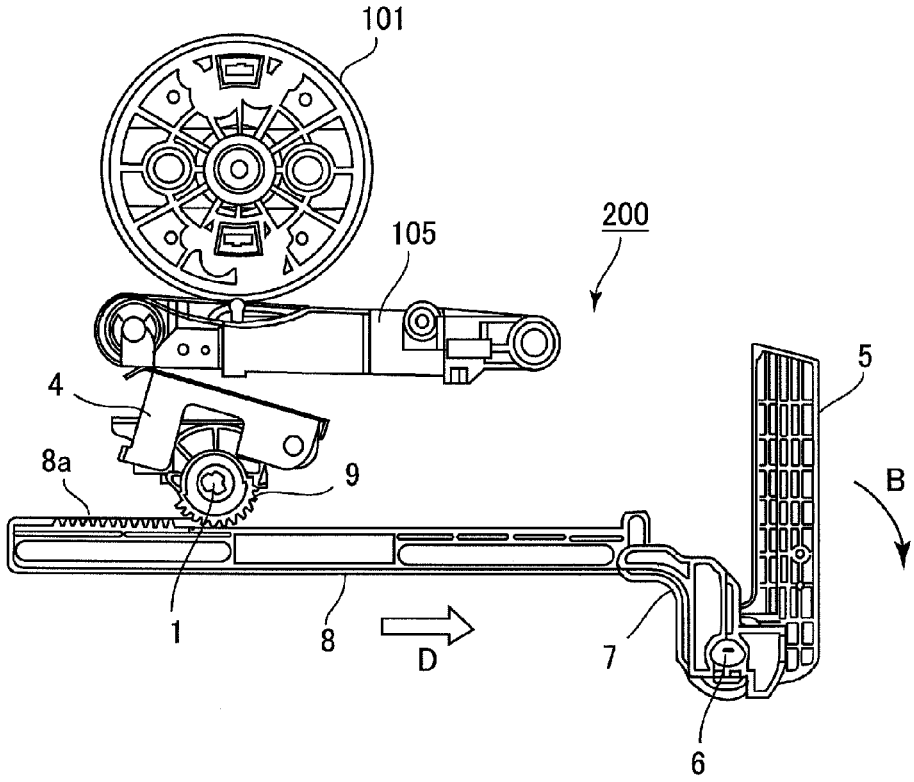
FIG. 6 is an illustration of a transmitting mechanism in a contact state.
Figure 7:
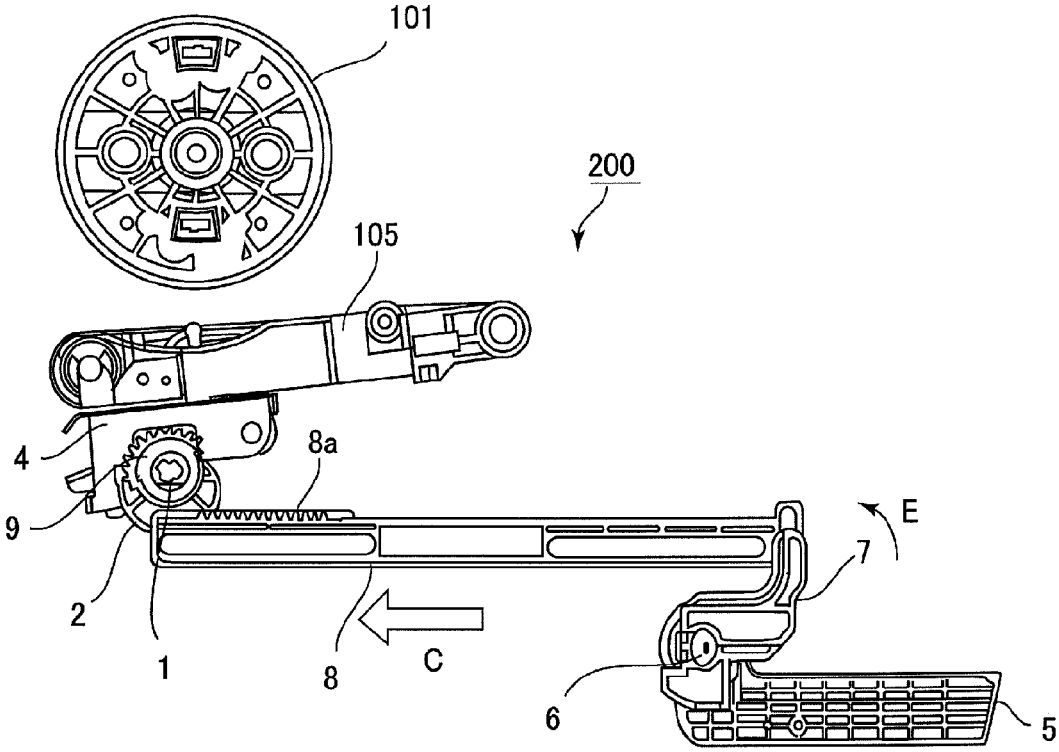
FIG. 7 is an illustration of the transmitting mechanism in an idling state in the spaced state.
Figure 8:
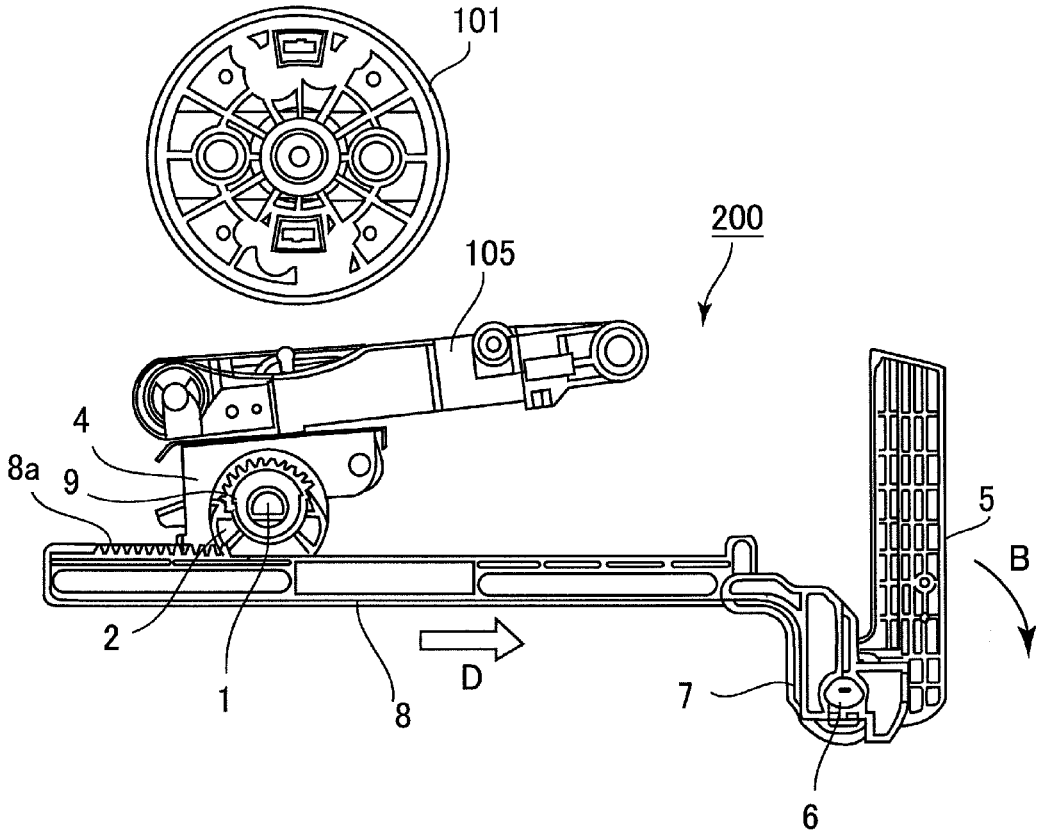
FIG. 8 is an illustration in the handle operation in the spaced state.

FIG. 5 is an illustration of an operation of a cam member. FIG. 6 is an illustration of a transmitting mechanism in a contact state. FIG. 7 is an illustration of the transmitting mechanism in an idling state in the spaced state. FIG. 8 is an illustration in the handle operation in the spaced state.

In FIG. 4, the gap between the pressing member 4 and the transfer unit 105 is enlarged for better explanation, but actually, as shown in FIG. 5, a pressing member 4 is contacted to a frame of the transfer unit 105 to move the end of the transfer unit 105 up and down.

As shown in FIG. 4, a handle shaft 6 is supported rotatably by the feeding unit 200, and the handle 5 is fixed to one end (front side of the feeding unit 200). The handle 5 and the handle shaft 6 are rotated manually between the first position (FIG. 6) and the second position (FIG. 7).

The handle shaft 6 is provided with a detent 14, and is urged by spring means toward the opposite ends a movement stroke thereof so that the handle 5 does not stop in a middle position. A locking member 13 is fixed to the handle shaft 6 and is effective to engage with the main assembly 120 of the image forming apparatus to position the handle shaft 6 in the main assembly 120 of the image forming apparatus so that the feeding unit 200 is not drawn out. The main assembly 120 of the image forming apparatus includes an inter-relating switch operable with rotation of the locking member 13 so that the electric power supply to a motor 12 is prohibited case the handle 5 is not in the first position. In the first position (fixed position), the feeding unit 200 is mounted to the main assembly of the image forming apparatus, and the feeding unit is fixed to the main assembly of the image forming apparatus.

The locking member 13 which is the of the locking mechanism fixes the feeding unit 200 relative to the main assembly 120 of the image forming apparatus so as not to be drawn out, when the handle 5 is in the first position. When the handle 5 is rotated in the direction of an arrow B by 90 degrees to the second position (release position), the locking member 13 releases the feeding unit 200.

As described hereinbefore, when the feeding unit 200 is to be loaded or taken out, the handle 5 is rotated in the direction of the arrow B by 90 degrees to release the feeding unit 200 from the main assembly 120 of the image forming apparatus. By this, as shown in FIG. 2, the feeding unit 200 can be drawn out toward the front side, and simultaneously, as shown in FIG. 7, the end of the transfer unit 105 lowers to space from the photosensitive drum 101, and therefore, the photosensitive drum 101 is not damaged.

A pressing shaft 1 is provided below the transfer unit 105 and is provided at each of the opposite ends a fixed pressing cam 2 for rotating the pressing member 4 to move the transfer unit 105 up and down. The pressing cam 2 which is an example of the cam member is provided on the feeding unit 200 to move the position of the transfer unit 105 relative to the photosensitive drum 101.

A pressing gear 3 is fixed to the pressing shaft 1 to transmit the driving force for rotating the pressing shaft 1 from the driving motor 12. The pressing gear 3 is provided with a one-way clutch 11 to transmit only the rotation of one direction from the driving motor 12 to the pressing shaft 1 and to idle for the rotation in the opposite direction.

As shown in (a) of FIG. 5, the stretching roller 105*c* side of the transfer unit 105 rotates about the driving roller 105*b* up and down. Actually, however, as shown in FIG. 4, a gear train is disposed, a relationship among the pressing gear 3, the one-way clutch 11 and the driving motor 12 is shown clearly.

By the driving motor 12 rotating the pressing cam 2 in the direction of an arrow A, the transfer unit 105 is moved up and down to automatically switch the contact state and the spaced state of the transfer belt 105 relative to the photosensitive drum 101. By the transfer belt 105*a* being contacted to the photosensitive drum 101, the image forming operation is enabled.

The description will be made as to the operation from the space state to the contact state. In the space state shown in (b) of FIG. 5, when the driving motor 12 operates, the pressing gear 3 rotates with the pressing shaft 1 and the pressing cam 2 in the direction A. The pressing member 4 rotates upwardly by being urged by the pressing cam 2, the end of the transfer unit 105 rises by the pressing member 4 so that the transfer unit 105 is contacted to the photosensitive drum 101 at a pressure.

The pressing member 4 has a dual structure with which it is rotatable about the rotational shaft 4*a*, a spring 4*b* is provided between the dual structure. When the transfer unit 105 is pressed to unshown abutments provided on the photosensitive drum 101, there is a variation in the distances through which the pressing cams 2 press the transfer unit 105. The spring 4*b* is effective to accommodate such a variation.

When the image forming operation is finished in the contact state shown in (a) of FIG. 5, the driving motor 12 is operated again to rotate the pressing gear 3 in the direction of A together with the pressing shaft 1 and the pressing cam 2, so that the transfer unit 105 is spaced from the photosensitive drum 101 as shown in (b) of FIG. 5. The rotational moving direction of the pressing gear 3 is the same between in the change from the space state to the contact state and in the change from the contact state to the space state.

As shown in FIG. 6, a transmitting mechanism (8, 9) is provided in order to space the transfer belt 105 from the photosensitive drum 101 in case that the electric power supply of the image forming apparatus is shut off, in the state that the transfer belt 105 and the photosensitive drum 101 are contacted to each other. Even if the driving motor 12 shown in (a) of FIG. 5 is not operated, the transmitting mechanism (8, 9) is such that the pressing cam 2 can be rotated in the direction opposite to the rotational direction of the driving motor 12 shown in (a) of FIG. 5 to space the transfer belt 105 from the photosensitive drum 101.

An arm 7 is fixed to the handle shaft 6, and the arm 7 rotates together with the handle shaft 6. The pressing shaft 1 is provided with a releasing sector gear 9 having a lacking teeth which rotates integrally with the pressing shaft 1. A frame of the feeding unit 200 is provided with an arm rack 8 connected with and slidably supported by the arm 7.

The arm rack 8 is slidingly movable between a position which is taken during the image forming operation shown in FIG. 6 and a position shown in FIG. 7 where the feeding unit can be drawn out. The arm rack 8 is brought into meshing engagement with the releasing gear 9 in the process of the sliding movement to rotate the pressing cam 2 in the direction opposite the rotational moving direction A of the pressing cam 2 shown in (a) of FIG. 5. With the rotation of the pressing cam 2, the transfer unit 105 is shifted from the contact state to the spaced state. Here, the rotational moving direction of the pressing cam 2 is opposite to the rotational moving direction by the driving motor 12.

As shown in FIG. 4, the feeding unit 200 has two driving trains branched out of the driving motor 12. A first driving train will be described. The first driving train transmits the driving force from the driving motor 12 to the pressing gear 3. In this embodiment, the pressing cam 2 is driven through a one-way clutch 11 provided between the driving motor 12 and the pressing gear 3 so that the transfer unit 105 is contacted to and spaced from the photosensitive drum 101.

The one-way clutch 11 is provided between the driving motor 12 and the pressing cam 2 to transmit the driving force only in one predetermined direction. The controller 112 transmits the rotation of the driving motor 12 in the first direction to the pressing shaft 1 through the one-way clutch 11 to rotate the pressing cam 2 thereby to switching alternately the contact state and the spaced state of the transfer unit 105. Thus, the one-way clutch 11 transmits the driving force from the driving motor 12 to the pressing gear 3 when the driving motor 12 rotates in the first direction. However, when the driving motor 12 rotates in the second direction, the one-way clutch 11 rotates idly not to transmit the driving force to the pressing gear 3.

A second driving train will be described. The second driving train drives a feeding roller 206 (FIG. 1) in a reversion path through a one-way clutch 16. The driving motor 12 rotates in a second direction which is opposite to the first direction at the time of direction of the pressing cam 2 in the direction A, so as to rotate the feeding roller 206 thereby to feed the recording material. The controller 112 rotates the driving motor 12 in such a direction of idling rotation of the one-way clutch 11 so that the feeding roller 206 for the recording material is rotated in a predetermined direction. When the driving motor 12 rotates in the first direction, the one-way clutch 16 idles so that the driving force is not transmitted to the feeding roller 206.

Therefore, when the driving motor 12 is rotated in one direction, the pressing cam 2 rotates, but the feeding roller 206 does not rotate. On the other hand, when the driving motor 12 is rotated in the opposite direction, the feeding roller 206 rotations, but the pressing cam 2 does not rotate. With such a structure, one driving motor 12 is enough to independently perform the contact/spacing operation of the transfer belt 105 and the recording material feeding operation for feeding the recording material at the time when the transfer unit 105 is contacted to the photosensitive drum 101.

<Transmitting Mechanism>

As shown in FIG. 6, the transmitting mechanism of Embodiment 1 includes the releasing sector gear 9 which is an example of a pinion gear integrally rotatable with the pressing cam 2, and the arm rack 8 which is an example of a rack gear for rotating the releasing sector gear 9 by is linear movement provided by the rotation of the handle 5.

A rack gear 8*a* of the arm rack 8 lacks gears in the ranges corresponding to the first position and the second position. Therefore, the arm rack 8 and the releasing sector gear does not interrelate the pressing cam 2 and the handle 5 with each other when the handle 5 takes the first position.

Therefore, the driving motor 12 rotates the pressing cam 2 in unidirectional without being confined by the arm rack 8 to switch the transfer unit 105 between the contact state and the space state alternately.

The releasing sector gear 9 and the rack gear 8*a* are engaged with each other in the process of the handle 5 moving from the first position to the second position. As a result, the movement of the rack 8 by the movement of the handle 5 rotates the sector gear 9.

In this embodiment, the pressing cam 2 and the sector gear 9 are mounted to the pressing shaft 1. Therefore, the rotation of the sector gear rotates the pressing shaft 1 and the pressing cam 2. The pressing cam 2 and the sector gear 9 are fixed on the pressing shaft 1 such that when a gear portion of the sector gear 9 opposes the rack gear 8*a*, the pressing cam 2 is in the position of contacting the transfer belt 105 to the photosensitive drum 101.

As a result, by rotation of the sector gear 9 through one half of the full rotation, the pressing cam 2 rotates through one half to permit the pressing cam 2 to move from a pressing position to the release position. By such an interrelation between the handle 5 and the pressing cam 2, the manual restoration of the pressing cam 2 to a reference position corresponding to the spaced state simultaneously shifts the transfer unit 105 to the spaced state.

The rack 8 and the sector gear 9 release the interrelation between the pressing cam member and the lever also when the handle 5 takes the second position. By this, also when the handle 5 takes the second position, the pressing cam 2 can be rotated by operating the driving motor 12.

As shown in FIG. 7, the arm rack 7 and the sector gear 9 releases the interrelation between the pressing cam 2 and the handle 5 irrespective of the position of the handle 5 when the transfer unit 105 is in the spaced state. The pressing cam 2 keeps stably the rotational position in which the lacking teeth portion faces to the rack 8 by the gravity applied to the transfer unit 105.

Therefore, once the spaced state is established, the space state of the transfer unit 105 is kept stably even if the handle 5 is operated inadvertently, and therefore, a unintentional contact of the transfer unit 105 to the photosensitive drum 101 can be avoided.

As shown in FIG. 6, when the transfer unit 105 is in the transfer pressing state in which it is contacted to the photosensitive drum 101, the releasing sector gear 9 and the arm rack 8 are not engaged with each other, the arm rack 8 does not interfere with the rotation of the pressing shaft 1.

Therefore, as shown in FIG. 4, when the driving motor 12 rotates the pressing gear 3 in the direction of the arrow A through the one-way clutch 11, the sector gear 9 rotates without engaging with the arm rack 8 to raise or lower the end of the transfer unit 105.

In the transfer pressing state shown in FIG. 6, when the handle 5 is rotated manually in the direction of the arrow B, it rotates to a releasing position shown in FIG. 7. As a result, the arm 7 rotates in the direction of the arrow B so that the rack 8 slides in the direction of an arrow D.

By this, the releasing sector gear 9 and the rack 8 are brought into engagement with each other by the movement of the rack 8. Thereafter, the sector gear 9 is driven the rack 8 to rotate the pressing shaft 1, and as shown in FIG. 7, the end of the transfer unit 105 lowers to space from the photosensitive drum 101.

As shown in FIG. 7, the handle 5 is rotated in the direction of an arrow E in the state that the transfer unit 105 is spaced from the photosensitive drum 101 and that the feeding unit 200 can be drawn out, the handle 5 rotates to the locking position shown in FIG. 8. As a result, the arm 7 rotates in the direction of an arrow E so that the rack 8 slides in the direction of an arrow C.

However, throughout this step, the teeth lacking zone of the sector gear 9 faces the arm rack 8, so that they are not engaged with each other, and therefore, the pressing shaft 1 does not rotate, and as a result, the transfer unit 105 keeps the spaced state relative to the photosensitive drum 101.

As shown in FIG. 8, the transfer unit 105 is spaced from the photosensitive drum 101, the feeding unit 200 is in the locking state, and therefore, the feeding unit 200 cannot be drawn out. When the handle 5 is rotated in the direction of an arrow B, it moves to the releasing position shown in FIG. 7. As a result, the arm 7 rotates in the direction of an arrow B so that the rack 8 slides in the direction of an arrow D.

In case that the recording material is jammed, or the electric power supply is shut off due to power failure, the image forming apparatus 100 is stopped in the state that the transfer unit 105 is press-contacted to the photosensitive drum 101 as shown in FIG. 6.

In such a case, when the handle 5 is rotated in the direction of the arrow B, the rack 8 slides in the direction of the arrow D to engage with the releasing sector gear 9. When continuing to rotate the handle 5 to the releasing position shown in FIG. 7, the rack 8 drives the releasing sector gear 9 to rotate the pressing shaft 1 and the pressing cam 2 by which the transfer unit 105 spaces from the photosensitive drum 101.

Simultaneously, the feeding unit 200 is released from the locking member 13 shown in FIG. 4 so that the feeding unit 200 becomes drawable to the front side of the main assembly 120 of the image forming apparatus.

In the image forming apparatus 100 of Embodiment 1, when the handle 5 is rotated to the releasing position in the direction of the arrow B, the drive type for driving the pressing shaft 1, the one-way clutch 11 disconnects the drive transmission between the pressing gear 3 and the driving motor 12. The rotational moving direction of the pressing cam caused by the handle 5 rotation is opposite to the rotational moving direction of the pressing cam caused by the driving motor 12. Therefore, the driving force of the handle 5 is not transmitted to the driving motor because the one-way clutch 11 rotates idly. Therefore, two driving force transmission lines from the driving motor 12 are provided, the driving force when the handle 5 is moved is shut by the one-way clutch 11, and therefore, the load for moving the handle 5 can be reduced. Irrespective of the state of the driving motor 12 side, the transfer unit 105 can be spaced from the photosensitive drum 101 by operating the handle 5 with a small force.

In image forming apparatus 100 of Embodiment 1, the contact and space of the transfer unit 105 relative to the photosensitive drum 101 is effected by the pressing cam 2 through the one-way clutch 11 by the rotation of the driving motor 12. One step operation of manual rotation of the handle 5 of the feeding unit 200 to release the locking is enough to space the transfer unit 105 from the photosensitive drum 101.

Therefore, in normal rotation of the handle 5, the pressing mechanism of the transfer unit 105 is not operated, and therefore, the required manipulating force for the handle 5 is small. In addition, in the case of the electric power supply failure, the handle 5 rotates the pressing shaft 1 in the direction of the idle rotation of the one-way clutch 11, and therefore, a reaction force is not received from the driving motor 12 side, and the required force is small.

Furthermore, the contact and spacing operation of the transfer unit 105 is in one step in the operation range of the pressing cam 2, and therefore, the required inside operation space of the machine can be made small and simple. For this reason, the feeding unit 200 can be downsized, and the small size product can be manufactured with a low cost.

Accordingly, a compact and low cost image forming apparatus can be provided in which the transfer unit 105 can be taken out forcedly by a light force when the apparatus abnormally stops due to power failure or the like.

<Embodiment 2>

In Embodiment 1, the belt member has been described as a transfer belt for carrying the recording material and for transferring the toner image from the photosensitive drum. However, the present invention is applicable to an endless belt other than the transfer belt, if the endless belt can be drawn out of an image forming apparatus.

For example, the present invention is applicable to an image forming apparatus of an intermediary transfer type in which an intermediary transfer unit integrally comprising an intermediary transfer belt and a supporting rotatable member can be drawn out of the main assembly of the image forming apparatus of the image forming apparatus.

In the image forming apparatus of the intermediary transfer type, a transfer unit including a transfer belt similar to that of Embodiment 1 may be used for a secondary transfer portion for transferring the toner image onto the recording material from the intermediary transfer belt.

The present invention is applicable to a full-color image forming apparatus including a recording material feeding belt contacted to a plurality of photosensitive drums for different developing colors. The present invention is applicable to an image forming apparatus wherein the recording material feeding belt is simultaneously spaced from the plurality of photosensitive drums and can be drawn out of the main assembly of the image forming apparatus.

As described in the foregoing, according to the present invention, even when the apparatus stops in the state that the transfer belt is contacted to the carrying member, the transfer belt can be spaced from the image bearing member without requiring a large space.

While the invention has been described with reference to the structures disclosed herein, it is not confined to the details set forth, and this application is intended to cover such modification or changes as may come within the purposes of the improvements or the scope of the following claims.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 044327/2010 filed Mar. 1, 2010 which is hereby incorporated by reference.

What is claimed is:

1. An image forming apparatus comprising:

an image bearing member;

a belt member which is rotatable in contact with said image bearing member and which is capable of being drawn out of a main assembly of the image forming apparatus;

a cam member for switching a position of said belt member relative to said image bearing member;

a motor for rotating said cam member;

control means for controlling said motor to contact and space said belt member relative to said image bearing member;

a lever movable between a first position in which said belt member is fixed to said main assembly of the image forming apparatus and a second position in which said belt member is capable of being drawn out of said main assembly of the image forming apparatus; and a spacing mechanism for spacing said belt member from said image bearing member by converting movement of said lever from the first position to the second position to a rotation of said cam member, when said belt member is contacted to said image bearing member.

2. An apparatus according to claim 1, wherein said spacing mechanism releases interrelation between said cam member and said lever when said lever is in the second position.

3. An apparatus according to claim 1, wherein said belt member can be drawn out in a longitudinal direction of said image bearing member, and said lever is disposed in a front side with respect to a drawing direction of said belt member and is movable between the first position and the second position.

4. An apparatus according to claim 1, further comprising a locking mechanism for locking said belt member to said main assembly of the image forming apparatus to prevent said belt member from being drawn out when said lever is in the first position, wherein when said lever is in the second position, said locking mechanism releases said belt member.

5. An apparatus according to claim 1, wherein said control means alternately switches a relation between said image bearing member and said belt member between a contact state and a space state by rotating said cam member unidirectionally in a first direction, and said spacing mechanism shift the relation from the contact state to the space state by rotating said cam member in a direction opposite to the first direction.

6. An apparatus according to claim 5, further comprising a one-way clutch, provided between said driving motor and said cam member, for transmitting the rotation in the first direction and not transmitting the rotation in the direction opposite the first direction.

7. An apparatus according to claim 1, wherein said spacing mechanism includes a pinion gear integrally rotatable with said cam member, a rack gear for being driven by rotation of said lever in a linear direction to rotate said pinion gear, wherein said rack gear is not provided with teeth in an engagement range corresponding to the first position and the second position, and said pinion gear is not provided with teeth in an engagement range corresponding to the space state.

8. An apparatus according to claim 1, wherein said belt member is a transfer belt for carrying a recording material.

9. An apparatus according to claim 1, wherein said belt member is an intermediary transfer belt for carrying a toner image transferred from said image bearing member.

* * * * *